United States Patent [19]

Höfling

[11] 4,227,605

[45] Oct. 14, 1980

[54] DRIVING UNIT FOR ESCALATORS FOR DRIVING THE STEP BAND

[75] Inventor: Peter Höfling, Dortmund, Fed. Rep. of Germany

[73] Assignee: O & K Orenstein & Koppel Aktiengesellschaft, Berlin, Fed. Rep. of Germany

[21] Appl. No.: 724,106

[22] Filed: Sep. 16, 1976

[30] Foreign Application Priority Data

Sep. 17, 1975 [DE] Fed. Rep. of Germany ..... 2541397

[51] Int. Cl.[2] ..... B66B 9/14

[52] U.S. Cl. ..... 198/331

[58] Field of Search ..... 198/330, 331, 855, 335; 187/20

[56] References Cited

U.S. PATENT DOCUMENTS

| | | | |
|---|---|---|---|
| 1,043,740 | 11/1912 | Sundh | 187/20 |
| 1,750,237 | 3/1930 | Mayer | 187/20 |
| 2,460,017 | 1/1949 | Lautrup et al. | 198/331 |
| 3,321,060 | 5/1967 | Mullis et al. | 198/331 |
| 3,696,909 | 10/1972 | Kojima et al. | 198/331 |
| 3,707,220 | 12/1972 | Boltrek et al. | 198/330 |

FOREIGN PATENT DOCUMENTS

| | | | |
|---|---|---|---|
| 2123851 | 12/1971 | Fed. Rep. of Germany | 198/855 |
| 2421729 | 5/1974 | Fed. Rep. of Germany | 198/331 |
| 1151601 | 2/1958 | France | 198/331 |
| 1575008 | 7/1969 | France | 198/331 |

*Primary Examiner*—Joseph E. Valenza
*Attorney, Agent, or Firm*—Becker & Becker, Inc.

[57] ABSTRACT

A driving unit for driving the circulating step band of escalators which is arranged inwardly of the step band and includes an electric motor, a transmission and a hand rail drive. The output shaft of the transmission simultaneously serves as main drive shaft for the step band. The electric notor has a housing which is formed by a rotor which is journalled in an overhung manner on the input shaft of the transmission. The torque of the transmission is absorbed through the intervention of a torque support by a handrail drive shaft which is driven by a chain or a gear transmission.

6 Claims, 6 Drawing Figures

DRIVING UNIT FOR ESCALATORS FOR DRIVING THE STEP BAND

The present invention relates to a driving unit which is arranged within the circulating step band of escalators. The driving unit comprises an electric motor, a transmission and a handrail drive, while the input shaft of the transmission simultaneously serves as main drive shaft for the step band.

With a heretofore known driving arrangement for escalators, the drive for the handrail which is arranged inwardly of the step band is combined with the main drive to a unit in order to obtain a compact drive. The driving wheels for the rails are connected to the drive by means of universal shafts. This known driving arrangement has the advantage that it requires a relatively small space and that it is not as liable to disorders as heretofore known drives. However, in view of the rather limited space available in connection with the layout of escalators, a still further reduction of the space requirement would be advantageous and a less complicated construction would benefit the economy of such installations.

It is, therefore, an object of the present invention to provide a driving arrangement for escalators which over heretofore known installations of the type involved requires considerably less space while simultaneously being more economical in view of its simplified construction.

This object and other objects and advantages of the invention will appear more clearly from the following specification in connection with the accompanying drawings, in which.

The driving unit according to the present invention is characterized primarily in that the rotor which forms the housing for the electric motor is mounted on the input shaft of the transmission in an overhung manner and that the torque of the transmission is absorbed through the intervention of a torque support by a handrail drive shaft which is driven by a chain and which is arranged perpendicularly to the input shaft.

According to a further development of the invention, the rotor housing of the drive motor is at its outer circumference designed as a brake drum for receiving a band brake. Instead of a band brake, also an inner jaw brake may be provided. In this instance the inner circumference of the rotor will serve as brake drum.

Figure 1:
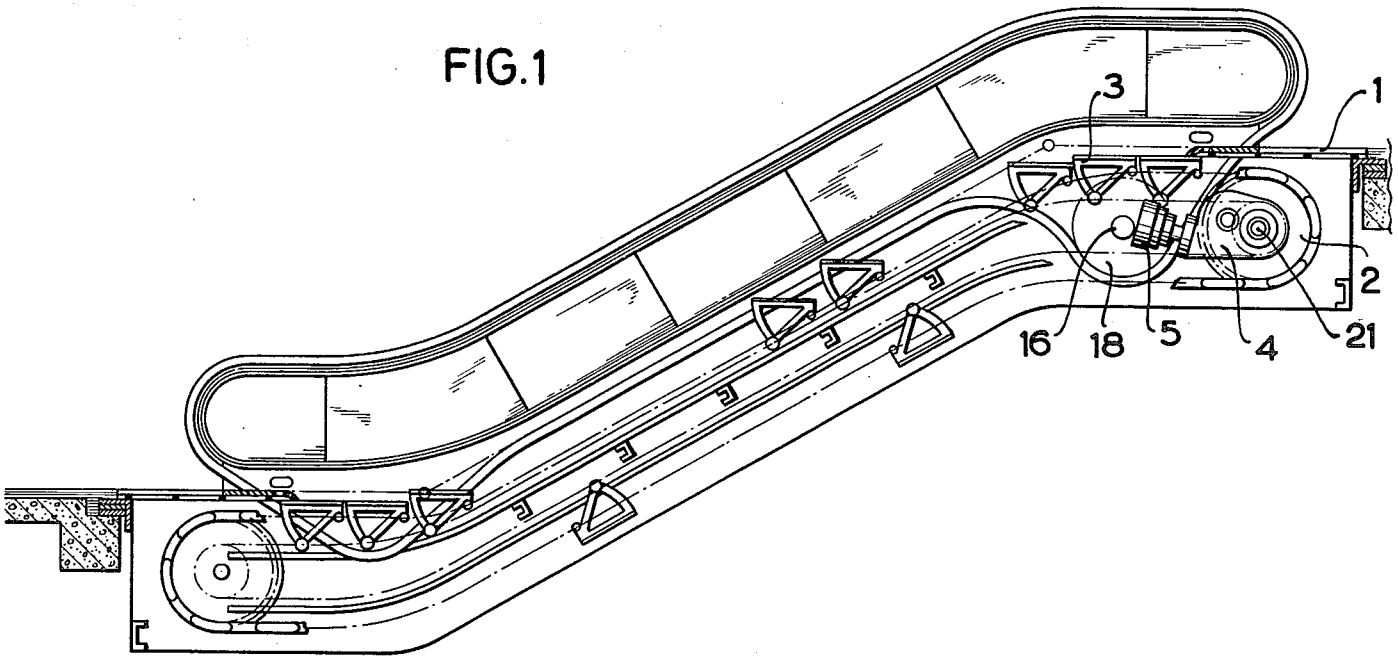
FIG. 1 represents a side view of the entire escalator with the driving arrangement according to the invention.
Figure 2:
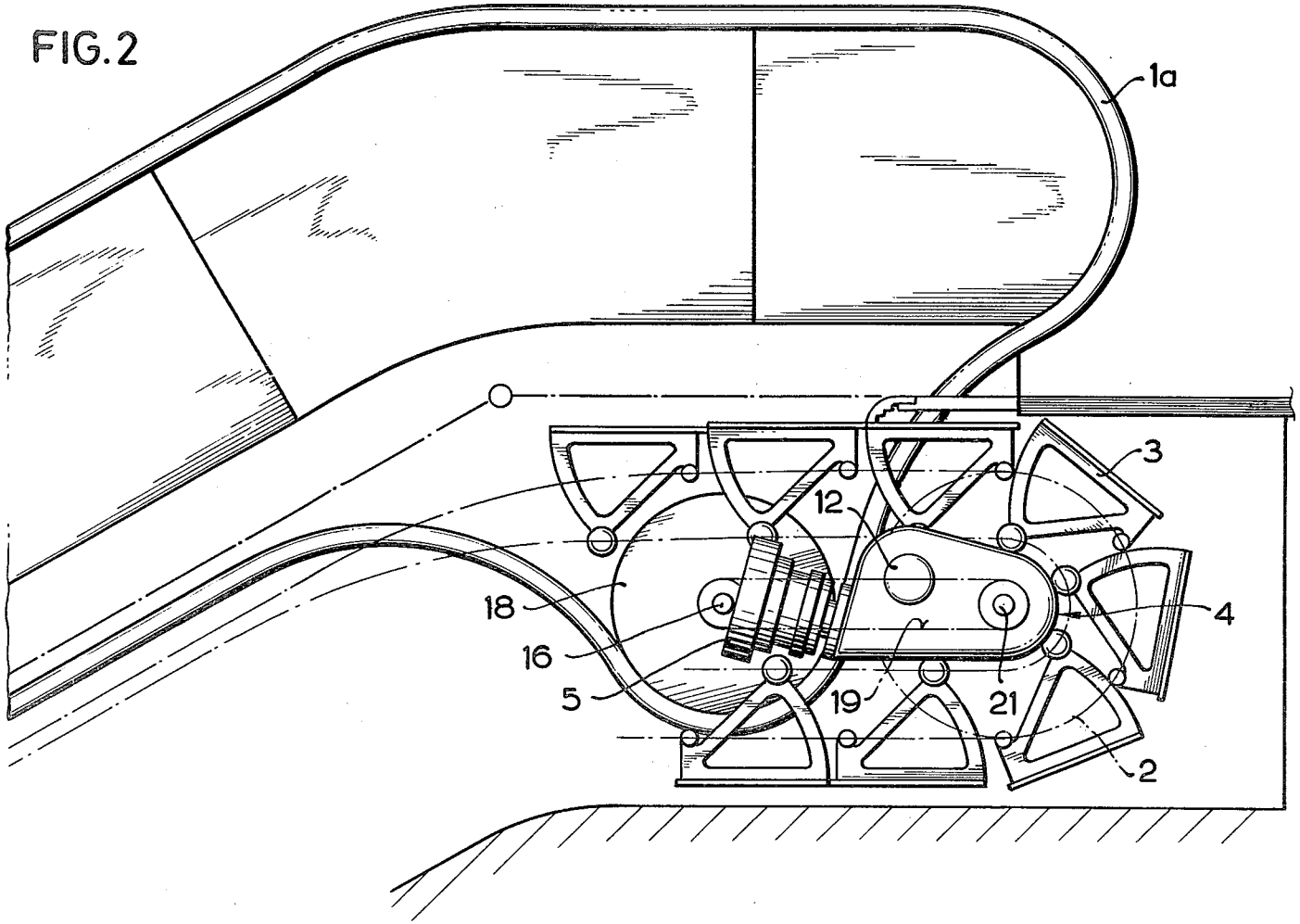
FIG. 2 illustrates the right-hand portion of FIG. 1 but on a considerably larger scale than that of FIG. 1.
Figure 3:
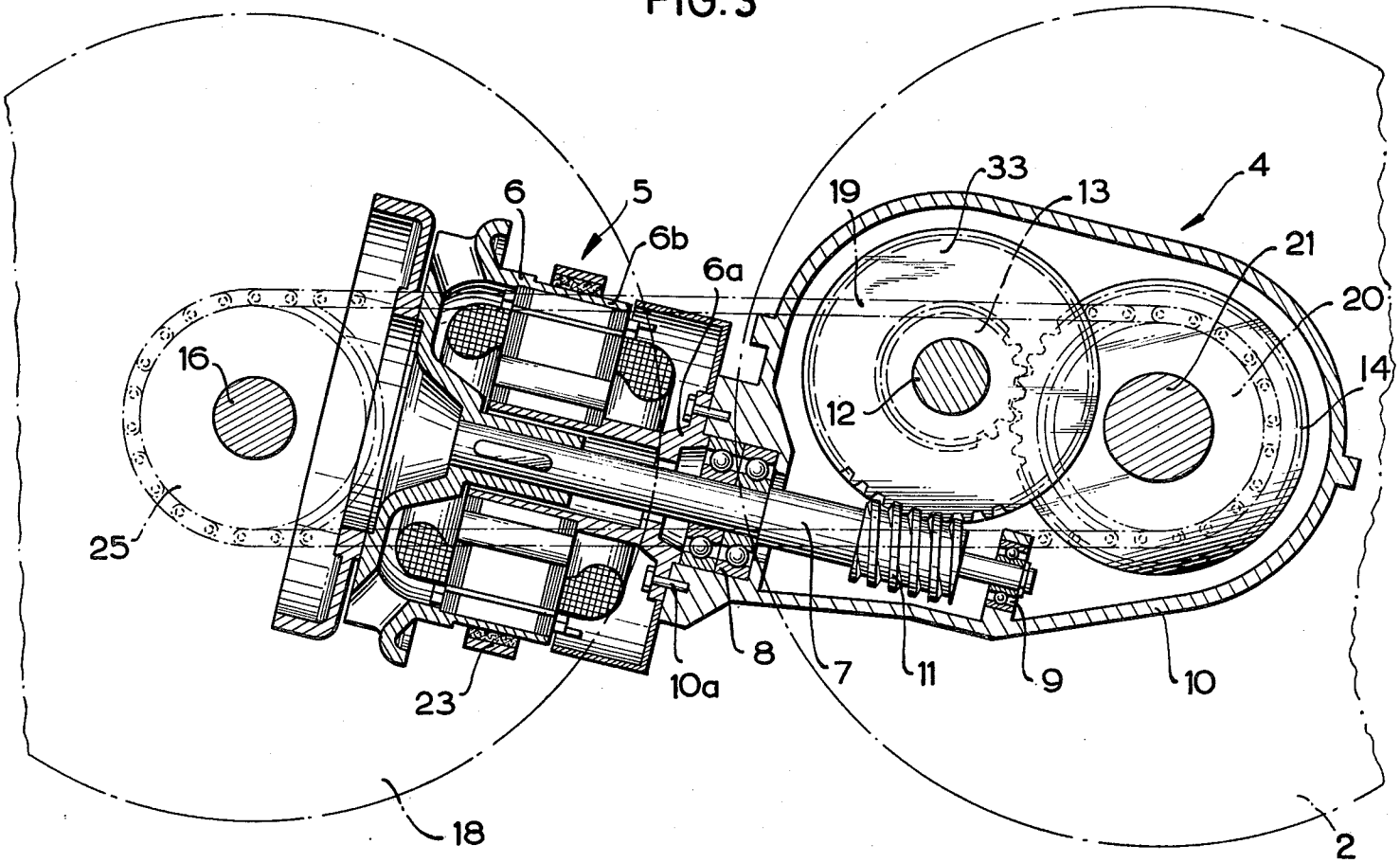
FIG. 3 represents a longitudinal section through the driving system according to the invention.
Figure 4:
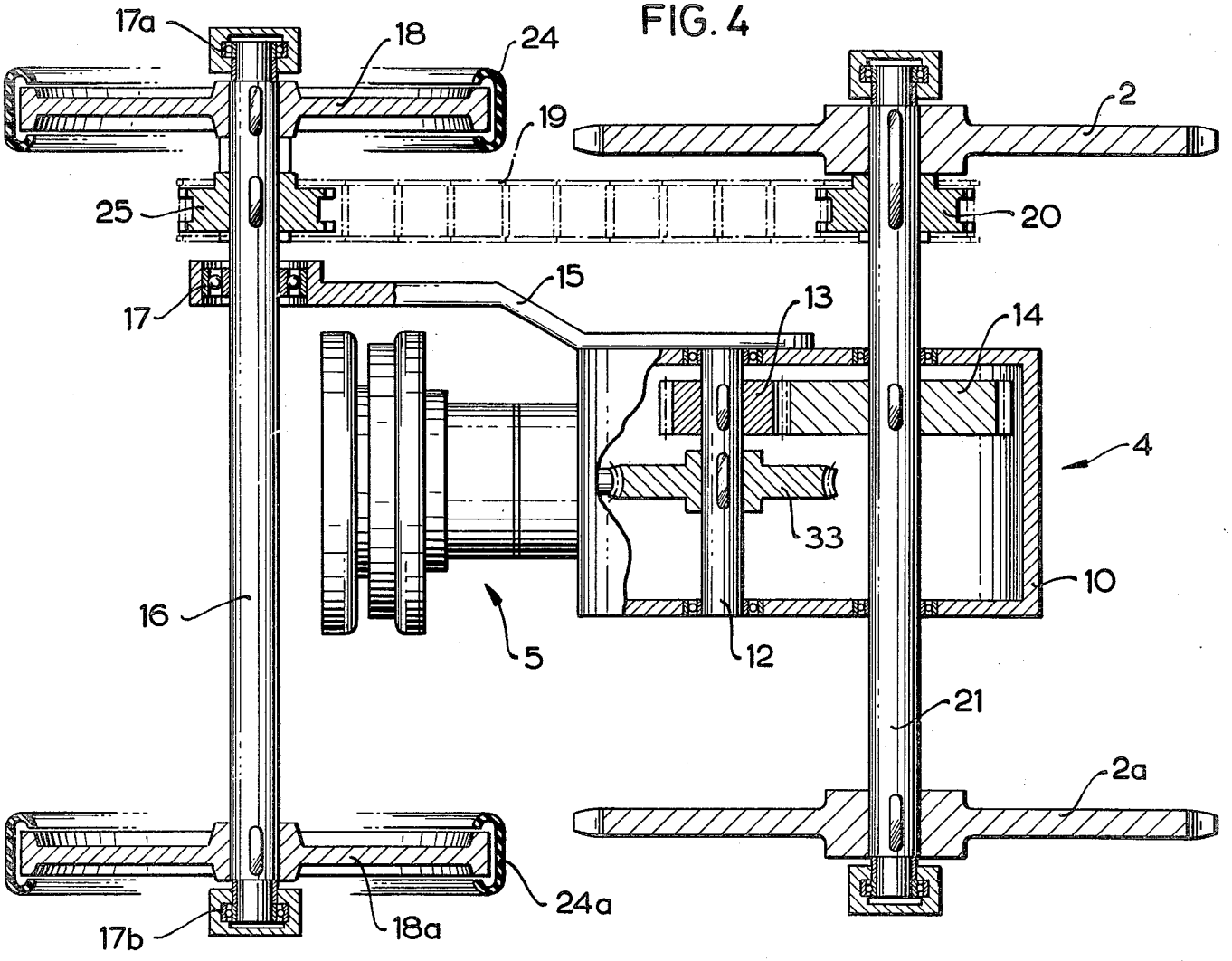
FIG. 4 is a top view of the driving arrangement according to the invention with handrail drive shaft and driving wheel.
Figure 5:
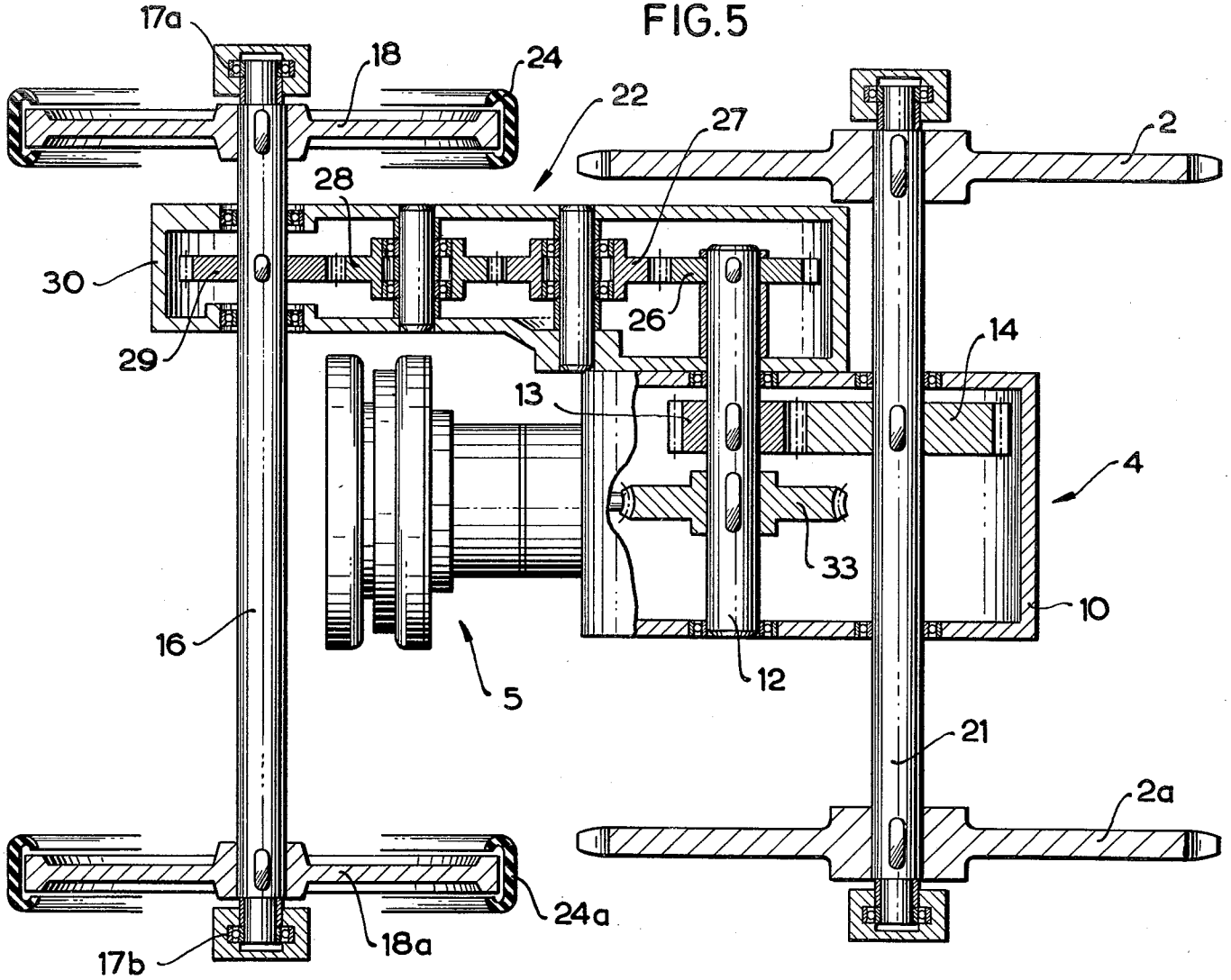
FIG. 5 is a top view of the driving arrangement according to the invention with a drive for the handrails by means of gears.

Referring now to the drawings in detail, the driving arrangement shown therein and comprising primarily the transmission 4 and the electric motor 5 is in the framework 1 of an escalator provided between the two sprocket wheels 2 and 2*a* (FIG. 4) and inwardly of the step band comprising the steps 3. The rotor 6 (FIG. 3) which simultaneously forms the housing for the electric motor 5 is by means of bearings 8 and 9 journalled in an overhung manner on the input shaft 7 and is located within the housing 10. The stator 6*a* which, carries the electric coils, is connected to the transmission housing 10 by means of screws 10*a* and serves simultaneously for termination of the housing and journalling of the input shaft 7. To the free ends of the input shaft 7 there is connected the worm 11 by means of which the driving force of the electric motor 5 is through a worm wheel 33 mounted on the intermediate shaft 12 and through the intervention of gears 13 and 14 conveyed to the main shaft 21 which thus simultaneously operates as drive shaft for the transmission. At its free ends, the main shaft 21 supports the sprocket wheels 2 and 2*a* for driving the step band comprising the steps 3. To the transmission housing 10 there is connected the moment or torque support 15 which by means of a bearing 17 rests on the handrail drive shaft 16. The drive shaft 16 is rotatably journalled in the bearings 17*a* and 17*b*. Connected to the free end of the handrail drive shaft 16 are the handrail driving wheels 18 and 18*a* which cooperate with the handrails 24 and 24*a*. The handrail drive shaft 16 is driven by a very short chain 19 which leads from the sprocket wheel 20 arranged on the main shaft 21 to the sprocket wheel 25 arranged on the handrail drive shaft 16. The rotor housing 6 has its outer circumferential portion designed as brake drum 6b which cooperates with the band brake 23.

Instead of the moment support 15, according to another embodiment of the invention, a handrail transmission 22 is flanged to the transmission housing 10. The handrail drive housing 30 of the transmission 22 takes over the function of the moment support 15. The driving force for the handrails 24 and 24*a* is transmitted by the intermediate shaft 12 through the intervention of the gear 26 connected to the intermediate shaft 12 and by the intermediate gears 27 and 28 and the gear 29 which latter is fixedly connected to the handrail drive shaft 16.

Figure 6:
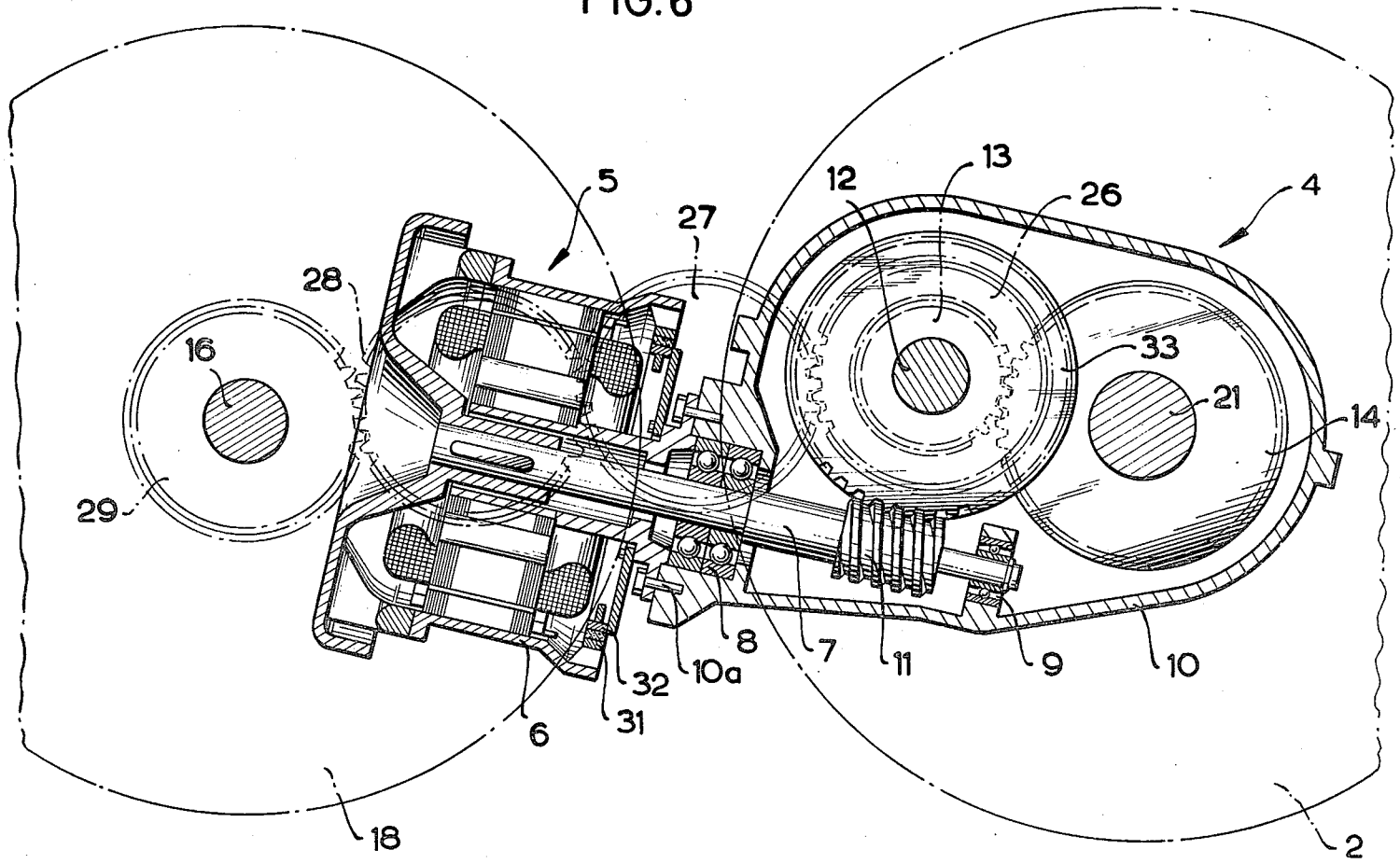
FIG. 6 is a longitudinal section through the driving arrangement according to the invention with an inner jaw brake.

According to another embodiment of the brake arrangement shown in FIG. 6, the rotor has its inner circumference designed as brake drum 31 which cooperates with an inner jaw brake 32. The rotor has one circumferential surface designed simultaneously as a brake drum to save space and to assure compactness of the driving unit; a housing encases the transmission means. The electric motor includes a stator flanged to the housing for the transmission means and forming a cover for the mount or journalling of a part of the input shaft means.

As will be evident from the above, the present invention brings about the advantage that not only the space for mounting of the driving arrangement will be considerably reduced over that required for heretofore known drives for escalators, but that the escalator itself and thus also the balustrade will become shorter. In view of the reduction in the mounting length, the handrail drive shaft may be arranged as rigid shaft directly behind the drive motor so that there will be obtained a very short chain length for the drive of the handrails while inherently thereto the chain will cause much less noise. Instead of using a chain, the drive may also be effected, in view of the obtained short mounting length, by means of a gear drive which is completely encapsuled.

It is, of course, to be understood that the present invention is, by no means, limited to the specific showing in the drawings but also comprises any modifications within the scope of the appended claims.

What I claim is:

1. In combination with an endless step band for an escalator having handrails: a driving unit arranged inwardly of said endless step band and comprising an electric motor and transmission means and handrail driving means for driving said handrails, said transmission means having input shaft means drivingly connected to said electric motor and also having output shaft means drivingly connected simultaneously to said handrail driving means and to said endless step band, said electric motor having an external rotor drivingly connected to said input shaft means and forming housing means for other parts of said electric motor and being journalled in an overhung manner on a portion of said input shaft means, said driving unit including a rigid handrail driving shaft and also including torque supporting means for simultaneously conveying the forces of the torque of said transmission means particularly to said rigid handrail driving shaft, said rotor having one circumferential surface designed simultaneously as a brake drum to save space and to assure compactness of the driving unit, a housing encasing said transmission means, and said electric motor including a stator flanged to said housing for said transmission means and simultaneously forming cover means for the mount of a part of said input shaft means.

2. A combination according to claim 1, in which said rotor has an outer circumferential surface designed as brake drum.

3. A combination according to claim 1, in which said rotor has an inner circumferential surface designed as brake drum.

4. A combination according to claim 1, in which said handrail driving shaft is arranged directly behind said electric motor, and in which said output shaft means includes a shaft drivingly connected to said handrail driving shaft.

5. A combination according to claim 1, which includes a short chain length for the drive of the handrails with less noise.

6. A combination according to claim 1, in which a completely encapsulated gear drive is provided for the handrails.

* * * * *